US007155014B1

(12) United States Patent
Hamman et al.

(10) Patent No.: US 7,155,014 B1
(45) Date of Patent: Dec. 26, 2006

(54) SYSTEM AND METHOD FOR PLAYING A LOTTERY-TYPE GAME

(75) Inventors: Robert D Hamman, Dallas, TX (US); Kenneth R Westerlage, Fort Worth, TX (US); William C Kennedy, Dallas, TX (US)

(73) Assignee: SCA Promotions, Inc., Dallas, TX (US)

( * ) Notice: Subject to any disclaimer, the term of this patent is extended or adjusted under 35 U.S.C. 154(b) by 850 days.

(21) Appl. No.: 09/917,379

(22) Filed: Jul. 26, 2001

(51) Int. Cl.
*A63F 9/24* (2006.01)

(52) U.S. Cl. ..... 380/251; 713/193

(58) Field of Classification Search ..... 308/251; 463/16–18, 42, 28–29; 380/251; 713/193
See application file for complete search history.

(56) References Cited

U.S. PATENT DOCUMENTS

| | | | | | |
|---|---|---|---|---|---|
| 4,157,829 | A | * | 6/1979 | Goldman et al. | 463/17 |
| 4,527,798 | A | | 7/1985 | Siekierski et al. | 273/86 R |
| 4,747,139 | A | * | 5/1988 | Taaffe | 380/44 |
| 4,832,341 | A | | 5/1989 | Muller et al. | 273/139 |
| 5,042,809 | A | | 8/1991 | Richardson | 273/138 A |
| 5,096,195 | A | * | 3/1992 | Gimmon | 463/20 |
| 5,197,736 | A | * | 3/1993 | Backus et al. | 273/142 R |
| 5,282,620 | A | | 2/1994 | Keesee | 273/138 A |
| 5,286,023 | A | | 2/1994 | Wood | 273/138 A |
| 5,380,007 | A | | 1/1995 | Travis et al. | 273/138 A |
| 5,398,932 | A | | 3/1995 | Eberhardt et al. | 273/138 A |
| 5,456,465 | A | | 10/1995 | Durham | 273/138 A |
| 5,505,449 | A | | 4/1996 | Eberhardt et al. | 273/138 A |
| 5,507,489 | A | | 4/1996 | Reibel et al. | 273/138 A |
| 5,524,035 | A | | 6/1996 | Casal et al. | 377/47 |
| 5,551,692 | A | | 9/1996 | Pettit et al. | 273/143 R |
| 5,569,082 | A | | 10/1996 | Kaye | 463/17 |
| 5,674,128 | A | | 10/1997 | Holch et al. | 463/42 |
| 5,709,603 | A | | 1/1998 | Kaye | 463/17 |
| 5,797,794 | A | | 8/1998 | Angell | 463/18 |
| 5,800,269 | A | | 9/1998 | Holch et al. | 463/42 |
| 5,830,064 | A | * | 11/1998 | Bradish et al. | 463/22 |
| 5,855,369 | A | | 1/1999 | Lieberman | 273/139 |
| 5,871,398 | A | * | 2/1999 | Schneier et al. | 463/16 |
| 5,879,234 | A | | 3/1999 | Mengual | 463/20 |
| 5,938,200 | A | | 8/1999 | Markowicz et al. | 23/246 |
| 5,954,582 | A | * | 9/1999 | Zach | 463/25 |
| 6,030,288 | A | | 2/2000 | Davis et al. | 463/29 |
| 6,033,308 | A | | 3/2000 | Orford et al. | 463/28 |
| 6,044,135 | A | | 3/2000 | Katz | 379/93.13 |
| 6,080,062 | A | | 6/2000 | Olson | 463/42 |
| 6,089,982 | A | | 7/2000 | Holch et al. | 463/42 |
| 6,099,408 | A | | 8/2000 | Schneier et al. | 463/29 |
| 6,146,272 | A | | 11/2000 | Walker et al. | 463/17 |
| 6,165,072 | A | | 12/2000 | Davis et al. | 463/29 |

(Continued)

OTHER PUBLICATIONS

"The Authoritative Dictionary of IEEE Standards Terms", Seventh Edition, p. 744.*

*Primary Examiner*—Emmanuel L. Moise
*Assistant Examiner*—Jeffrey Popham
(74) *Attorney, Agent, or Firm*—Baker Botts L.L.P.

(57) ABSTRACT

A system for playing a lottery-type game includes a play generator, a win generator, and an evaluator. The evaluator receives the playfile from the play generator and a winning a number from the win generator and, in response to player input, determines a win/loss result. The evaluator may perform a record-by-record decryption of the playfile for each game play.

35 Claims, 6 Drawing Sheets

U.S. PATENT DOCUMENTS

| | | | | |
|---|---|---|---|---|
| 6,168,521 | B1 | 1/2001 | Luciano et al. | 463/18 |
| 6,183,301 | B1 * | 2/2001 | Cummings et al. | 463/18 |
| 6,183,361 | B1 | 2/2001 | Cummings et al. | 463/18 |
| 6,264,557 | B1 | 7/2001 | Schneier et al. | 463/29 |
| 6,277,026 | B1 | 8/2001 | Archer | 463/42 |
| 6,280,328 | B1 | 8/2001 | Holch et al. | 463/42 |
| 6,308,256 | B1 * | 10/2001 | Folmsbee | 712/209 |
| 6,322,446 | B1 * | 11/2001 | Yacenda | 463/16 |
| 6,325,716 | B1 | 12/2001 | Walker et al. | 463/17 |
| 6,331,143 | B1 | 12/2001 | Yoseloff | 463/18 |
| 6,595,855 | B1 * | 7/2003 | Sako | 463/29 |
| 6,609,116 | B1 * | 8/2003 | Lotspiech | 705/57 |
| 6,636,892 | B1 * | 10/2003 | Philyaw | 709/217 |
| 2001/0003098 | A1 | 6/2001 | Moody | 463/17 |
| 2001/0003100 | A1 | 6/2001 | Yacenda | 463/41 |
| 2001/0036853 | A1 | 11/2001 | Thomas | 463/17 |
| 2001/0046891 | A1 | 11/2001 | Acres | 463/18 |
| 2002/0002076 | A1 | 1/2002 | Schneier et al. | 463/29 |
| 2002/0006821 | A1 | 1/2002 | Park | 463/17 |
| 2002/0010015 | A1 | 1/2002 | Acres | 463/18 |
| 2002/0184485 | A1 * | 12/2002 | Dray et al. | 713/150 |

* cited by examiner

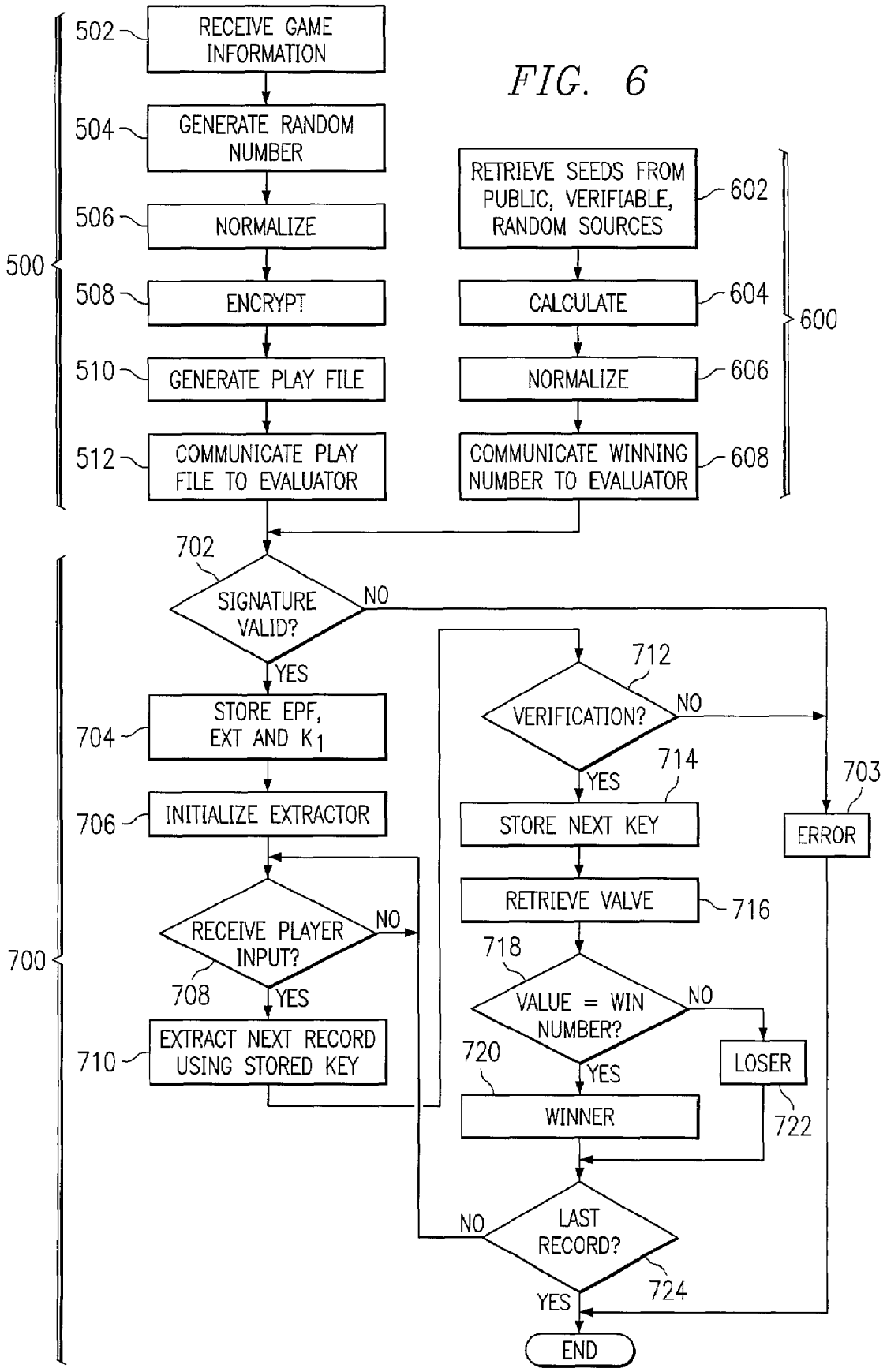
FIG. 6
500
502
RECEIVE GAME INFORMATION
504
GENERATE RANDOM NUMBER
506
NORMALIZE
508
ENCRYPT
510
GENERATE PLAY FILE
512
COMMUNICATE PLAY FILE TO EVALUATOR
600
602
RETRIEVE SEEDS FROM PUBLIC, VERIFIABLE, RANDOM SOURCES
604
CALCULATE
606
NORMALIZE
608
COMMUNICATE WINNING NUMBER TO EVALUATOR
700
702
SIGNATURE VALID?
NO
YES
704
STORE EPF, EXT AND K1
706
INITIALIZE EXTRACTOR
708
RECEIVE PLAYER INPUT?
NO
YES
710
EXTRACT NEXT RECORD USING STORED KEY
712
VERIFICATION?
NO
YES
714
STORE NEXT KEY
716
RETRIEVE VALVE
718
VALUE = WIN NUMBER?
NO
YES
720
WINNER
LOSER
722
703
ERROR
724
LAST RECORD?
NO
YES
END

SYSTEM AND METHOD FOR PLAYING A LOTTERY-TYPE GAME

TECHNICAL FIELD OF THE INVENTION

The present invention relates generally to gaming systems and techniques and more particularly to a system and method for playing a lottery-type game.

BACKGROUND OF THE INVENTION

The gaming industry continues to grow in popularity with a wide variety of new games and technologies that offer different experiences to players. Often the draw of such lottery-type games is the instant satisfaction of knowing whether you have won a prize. Game sponsors seek games that are exciting and immediate, but secure and verifiable. Game sponsors also need the ability to clearly set and maintain odds for a game to ensure profitability.

Security breaches, odds manipulation, and other fraudulent efforts to claim a prize continue to plague game sponsors. Fraud becomes a real concern in computer-based instant win promotions in which outcomes may be determined dynamically in response to player input. In some gaming systems that include a distributed or accessible architecture, hackers may intercept or modify messages, generate bogus plays or results in real-time, or hack into a database that controls the game.

SUMMARY OF THE INVENTION

In accordance with the present invention, a system and method for playing a lottery-type game includes a playfile that is generated and processed to reduce gambling fraud.

In a particular embodiment of the present invention, a system for playing a lottery-type game includes a play generator that generates a playfile. The playfile includes a number of records, and each record contains a numeric value. A win generator generates a winning number. An evaluator receives the playfile and the winning number, and retrieves a record from the playfile in response to input from a player. The evaluator compares a numeric value in the retrieved record to the winning number, and communicates a win/loss result to the player.

In another embodiment of the present invention, a method for playing a lottery-type game includes storing a playfile received from a remote location, the playfile includes a number of records, and each record contains a numeric value; determining a winning number; receiving input from a player; retrieving a record from the playfile in response to the input; comparing a numeric value in the retrieved record to the winning number; and communicating a win/loss result to the player.

Embodiments of the present invention provide various technical advantages. Existing computer-based gaming techniques may be susceptible to a variety of security breaches or hacks. This is particularly true in a distributed or accessible architecture, such as a client/server environment, that generates win/loss results in real-time. In one embodiment of the present invention, a playfile allows a game sponsor to establish a number of plays at a win probability prior to playing the game. An evaluator retrieves records individually from the playfile in response to each player input. To decrease potential tampering with the playfile, the present invention may adopt any number of techniques, such as embedded key encryption, record-by-record extraction, string verification, or any other suitable technique to ensure secure and accurate individual record retrievals from the playfile in response to player input. Another technical advantage of certain embodiments of the present invention include the generation of a winning number using seeds from public, verifiable random sources. These sources may include published, independent lottery results, such as winning numbers from state lotteries.

Other technical advantages of the present invention will be readily apparent to one skilled in the art from the following figures, description, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which:

FIG. 6 is a flow chart illustrating the operation of the system.

DETAILED DESCRIPTION OF THE INVENTION

Figure 1:
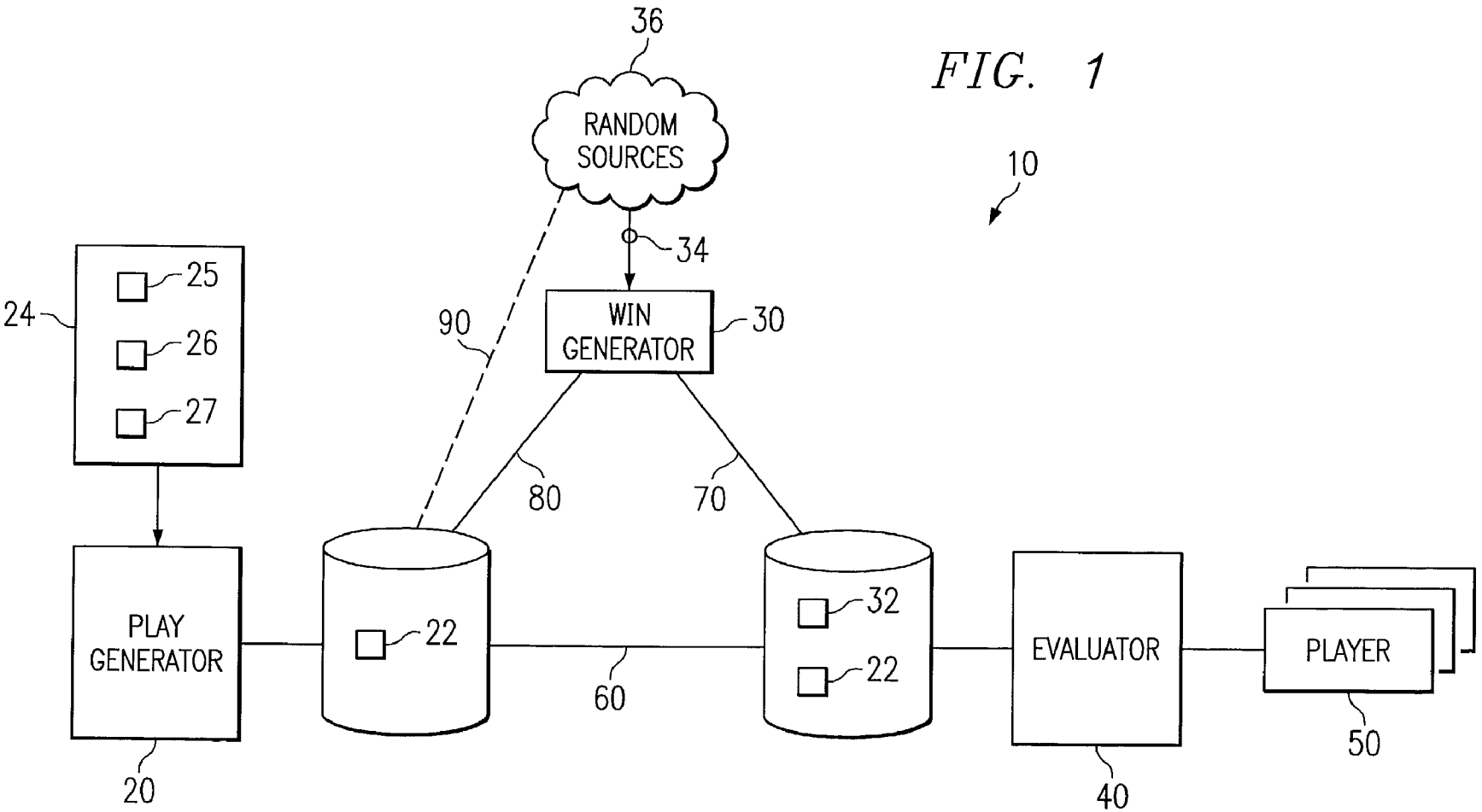
FIG. 1 illustrates a system that includes a play generator, a win generator, and an evaluator in accordance with the present invention.

FIG. 1 illustrates a system 10 for playing a lottery-type game that includes a play generator 20, a win generator 30, and an evaluator 40. Evaluator 40 receives a playfile 22 from play generator 20 and a winning number 32 from win generator 30. In response to input from players 50, evaluator 40 furnishes win/loss results using playfile 22 and winning number 32.

Play generator 20 may be a computer or other processing device that receives game information 24 for a specified game, such as an instant win game, lottery, scratch card, video poker, or any other suitable promotion or game of chance (generally referred to as a "lottery-type game"). Game information 24 may include, for example, the number of plays 25 for a given game, the desired win probability 26, and/or a winning number algorithm 27 that may be used by win generator 30 to generate winning number 32. Using game information 24, play generator 20 generates playfile 22 for communication to evaluator 40. Play generator 20 may also independently store playfile 22 for later winner verification.

A game sponsor may operate play generator 20 to generate a number of playfiles 22 for different games having varied game information 24. The sponsor may then charge a certain amount of money for playfile 22 based on the number of plays 25, the win probability 26, and the value of the one or more possible prizes that may be claimed by players 50. In this manner, play generator 20 produces any number of playfiles 22 for any number and variety of games, and allows the sponsor to predetermine the number of plays 25 and winning probability 26 for accurately pricing the game. An important aspect of the operation of play generator 20 is the ability to preset the parameters of each game, and provide playfile 22 that reflects these game parameters and reduces potential game fraud.

Win generator 30 may be a computer or other processing device that is integral to or separate from evaluator 40. Win generator 30 receives a number of seeds 34 from public random sources 36 to generate winning number 32. Random sources 36 may include lottery results, generated or environmental noise, weather data, or other available random, pseudo-random, or unpredictable numeric results. Throughout this description, the term "random" refers to any random, pseudo-random, or otherwise unpredictable value used or generated by system 10. In a particular embodiment, random sources 36 include lottery results (e.g., state, county, city lotteries) that are independent from the operation of play generator 20 and published for purposes of verification. Win generator 30 may truncate, concatenate, partially select, digit flip, or otherwise process published, independent lottery results to produce winning number 32. In a particular embodiment, win generator 30 generates winning number 32 after evaluator 40 successfully receives and stores playfile 22.

Evaluator 40 receives playfile 22 from play generator 20 and winning number 32 from win generator 30. Evaluator 40 receives playfile 22 from play generator 20 using link 60, which may represent a remote or local electronic communication path, mail or hand delivery of electronic media (e.g., using a disk, CD-ROM, or other magnetic or optical media), or other technique or facility to make playfile 22 available to evaluator 40. Similarly, evaluator 40 receives winning number 32 using link 70, which contemplates all of the delivery or availability techniques associated with link 60. As described above, win generator 30 may be integral to evaluator 40, and in a particular embodiment, generates winning number 32 only upon successful receipt and storage of playfile 22 by evaluator 40.

Evaluator 40 may be a computer or other processing device that has access to playfile 22 and winning number 32. For example, the functionality of evaluator 40 may reside on a server or other computing platform for delivering an online lottery-type game over a local area network (LAN), a wide area network (WAN), a global network such as the Internet, or any other suitable network or communication facility. Evaluator 40 may also reside on a stand-alone device, for example, an electronic slot machine, video poker, or other computer-based casino game. System 10 generally contemplates any location, configuration, or arrangement of play generator 20, win generator 30, and evaluator 40 in one or more local or distributed components to provide a game playing experience to users of players 50.

In operation of system 10, play generator 20 receives game information 24 and generates a suitable playfile 22 for communication to evaluator 40 using link 60. Win generator 30 retrieves seeds 34 from random sources 36 and generates winning number 32 for communication to evaluator 40 using link 70. Upon receiving and storing playfile 22 and receiving winning number 32, evaluator 40 is ready to receive input from one or more players 50. As used in this description, player refers to any device or process, whether implemented in hardware and/or software, that allows a user to participate in game playing in system 10. The user operating player 50 may activate a keyboard, mouse, touch screen, or other input device to initiate the game. Player 50 communicates the input to evaluator 40, and evaluator 40 provides a win/loss result to player 50. Player 50 uses a display, speaker, or other output device to convey the win/loss result to the user. Players 50 may represent one or more stand-alone and/or networked devices supported by evaluator 40.

Upon determining a winner among players 50, system 10 provides a verification technique that allows play generator 20 to verify the winner. In a particular embodiment, play generator 20 receives winning number 32 generated by win generator 30 using link 80 or independently generates winning number 32 using seeds 34 from random sources 36 received using link 90. Links 80 and 90 contemplate any of the delivery and availability techniques associated with link 60. Play generator 20 may independently generate winning number 32 using the originally specified winning number algorithm 27 in game information 24 as well as publicly available seeds 34 retrieved from random sources 36. Since play generator 20 maintains a copy of unmodified playfile 22 as communicated to evaluator 40, and independently determines winning number 32 from public sources, play generator 20 verifies the accuracy of a winner. One advantage of a particular embodiment of system 10 is the ability of play generator 20, often operated by an entity separate from the game promoter, to verify a prize claim using seeds 34, random sources 36, winning number algorithm 27, and unmodified playfile 22.

Figure 2:
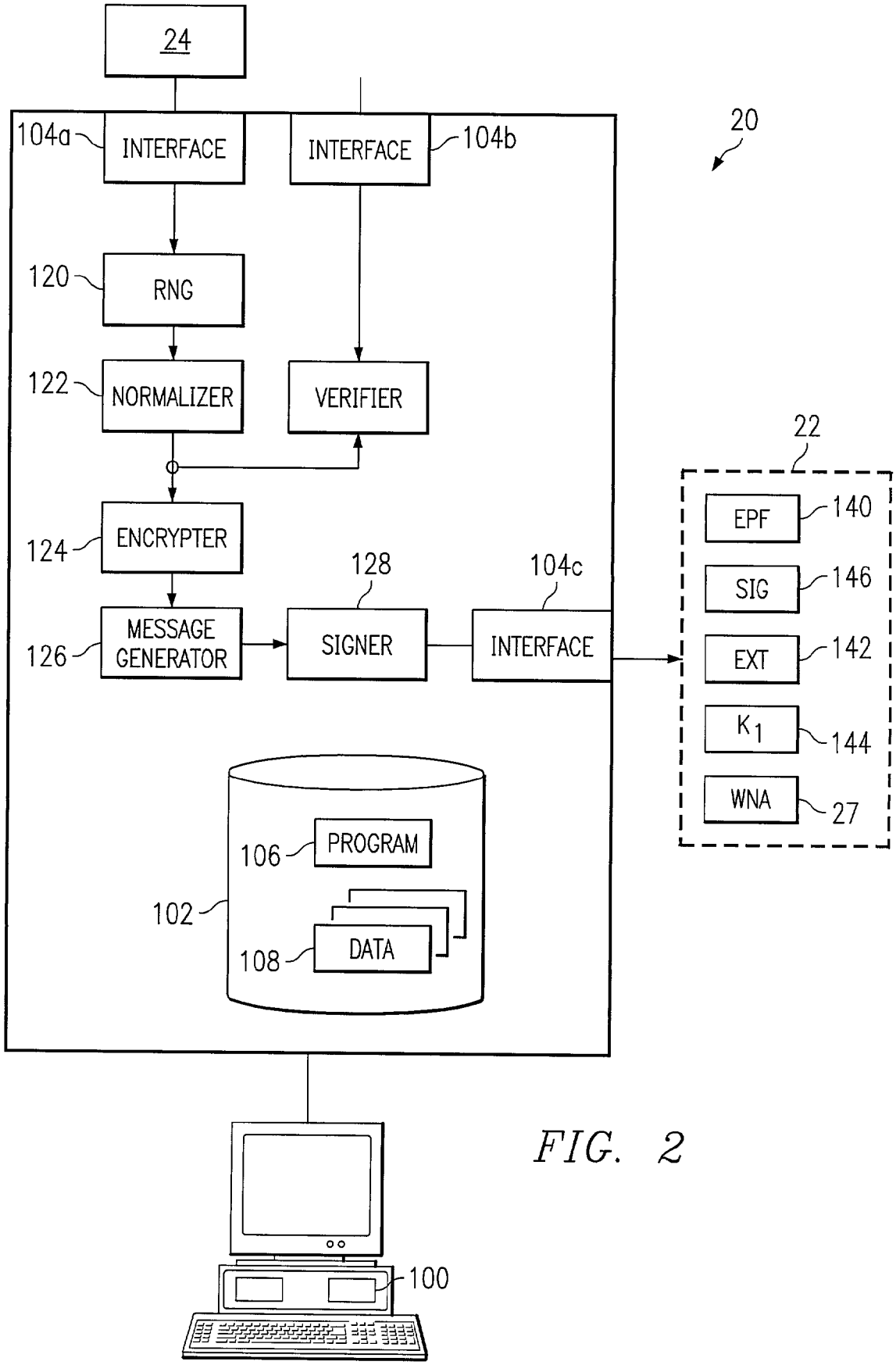
FIG. 2 is a block diagram illustrating exemplary components of the play generator.

FIG. 2 is a block diagram illustrating exemplary components of play generator 20. Play generator 20 may operate on a computer or other processing device, and includes generally a processor 100, memory 102, and one or more separate or integral interfaces 104 to receive information from or communicate information to other components in system 10. In the particular embodiment shown, interface **104*a* receives game information 24, interface 104*b* provides communication between play generator 20 and win generator 30 and/or random sources 36, and interface 104*c* provides communication of playfile 22 to link 60**.

Processor 100 may be a microprocessor, controller, or other suitable processing device that allows play generator 20 to perform its features and functions. Memory 102 includes a program 106 executed by processor 100 to control the overall functions and operation of play generator 20. The functions of program 106 are shown as modules (described below), but play generator 20 contemplates any arrangement and coordination of functions and features in one or more hardware and/or software components to accomplish the purposes of play generator 20. Memory 102 also stores data 108, which may include intermediate or final components of programs, data, or other information to be included in playfile 22.

In operation, play generator 20 receives game information 24 at interface **104*a* and passes this information to random number generator (RNG) 120. RNG 120 generates numeric values based on the number of plays 25 and win probability 26 in game information 24. For example, RNG 120 may generate a series of numbers between zero and ten million with a uniform distribution. Normalizer 122 receives numeric values generated by RNG 120 and applies any suitable normalization, processing, or other adjustment to ensure numeric values generated by RNG 120 comply with the desired win probability 26. Encrypter 124 takes each of the numeric values and generates individual encrypted records for each play to generate an encrypted playfile (EPF) 140. In a particular embodiment, encrypter 124 utilizes a record-by-record encryption technique that allows evaluator 40 to retrieve numeric values individually in response to each play of the game. Message generator 126 receives EPF 140 and combines other components of playfile 22 into a message file, or other suitable data structure for communication to evaluator 40. For example, message generator 126** may also include an extractor (EXT) 142 used to perform the record-by-record decryption of EPF 140 at evaluator 40. Message generator 126 may also include a first key ($K_1$) 144 used by the record-by-record decryption techniques of evaluator 40 described below with reference to FIG. 5. Signer 128 generates an electronic signature, cyclic redundancy check (CRC), checksum, or other data that may be used by evaluator 40 to verify the accurate receipt of playfile 22. The results of this processing performed by signer 128 may be included as a signature (SIG) 146 included in playfile 22.

Play generator 20 produces playfile 22 with its associated components in response to game information 24 received at interface 104*a*. Play generator 20 may generate additional playfiles 22 for other games specified by additional sets of game information 24. In this manner, play generator 20 may generate playfiles 22 for a variety of games with different parameters for the number of plays 25, win probability 26, winning number algorithms 27, and other suitable settings. Playfile 22 may include any arrangement and selection of components in separate or integral form. Playfile 22 typically includes encrypted or unencrypted records that include a numeric value for each play of the game specified by game information 24.

Figure 3:
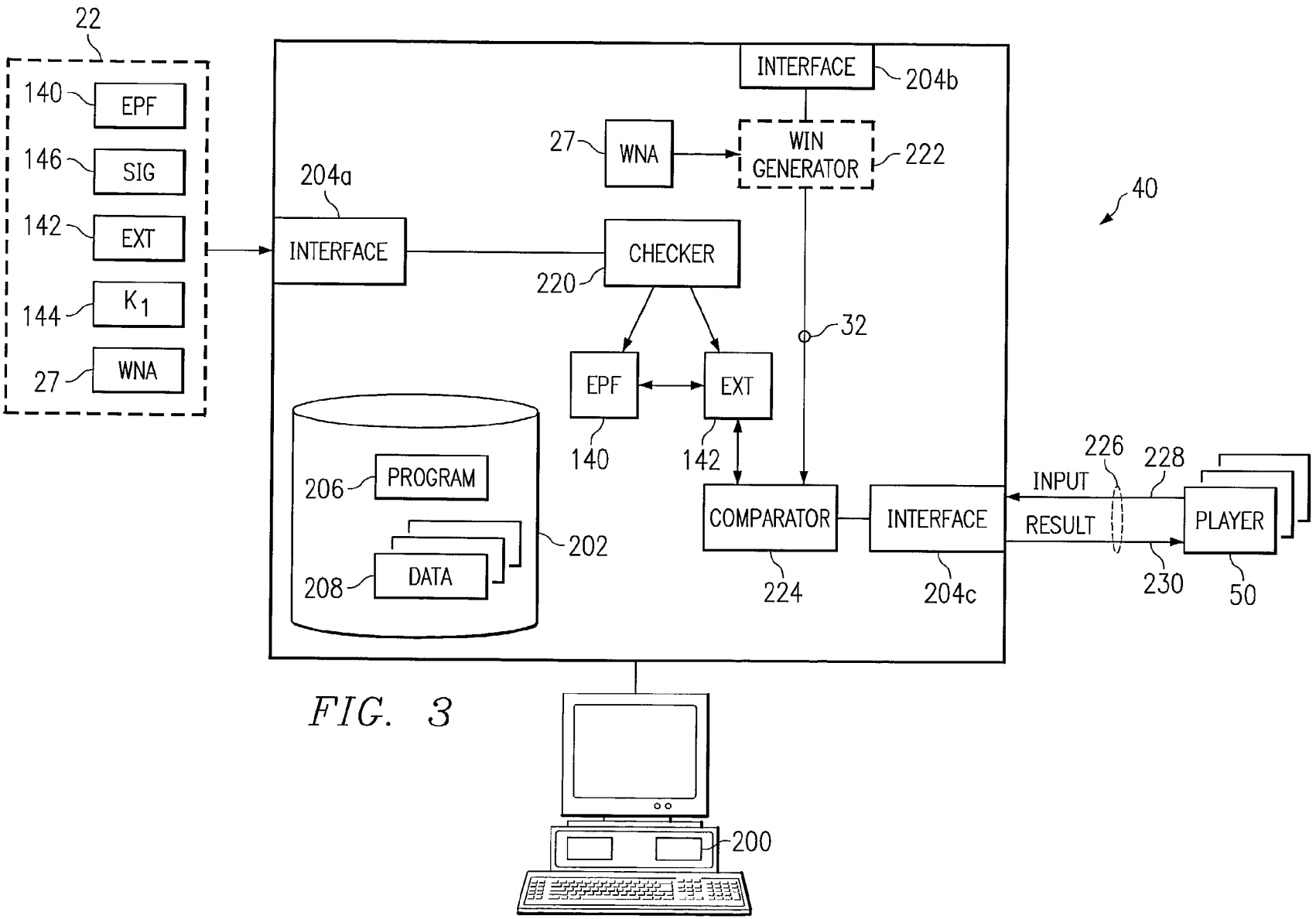
FIG. 3 is a block diagram illustrating exemplary components of the evaluator.

FIG. 3 is a block diagram illustrating exemplary components of evaluator 40. Evaluator 40 may operate on a computer or other processing device, and includes generally a processor 200, memory 202, and one or more separate or integral interfaces 204 to receive information from or communicate information to other components in system 10. In the particular embodiment shown, interface 204*a* receives playfile 22, interface 204*b* provides communication between evaluator 40 and win generator 30 and/or random sources 36, and interface 204*c* provides communication with players 50.

Processor 200 may be a microprocessor, controller, or other suitable processing device that allows evaluator 40 to perform its features and functions. Memory 202 includes a program 206 executed by processor 200 to control the overall functions and operation of evaluator 40. The functions of program 206 are shown as modules (described below), but evaluator 40 contemplates any arrangement and coordination of functions and features in one or more hardware and/or software components to accomplish the purposes of evaluator 40. Memory 202 also stores data 208, which may include intermediate or final components of programs, data, or other information used by evaluator 40.

In operation, interface 204*a* receives playfile 22 and its related components and passes this information to checker 220, which uses SIG 146 to verify the accurate receipt of all components of playfile 22. Upon verifying using SIG 146, evaluator 40 stores playfile 22 as data 208 in memory 202. Evaluator 40 retrieves and initializes EPF 140 and EXT 142, which together operate to extract, on a record-by-record basis, numeric values stored in EPF 140. Evaluator 40 also receives at interface 204*b* either winning number 32 or associated seeds 34 from random sources 36 that allow evaluator 40 to compute winning number 32 using winning number algorithm (WNA) 27 received in playfile 22. Using either directly supplied winning number 32 from an external win generator 30 or based on computations of an internal win generator 222, evaluator 40 passes winning number 32 to comparator 224.

Player 50 communicates an input 228 to comparator 224 using interface 204*c*. This may be performed in response to some action taken by a user of player 50, such as depressing a button, pulling a lever, or other activity, that generates an electronic signal sent over a local or remote communication path 226 to evaluator 40. In response to input 228, comparator 224 requests the next record in EPF 140 from EXT 142. EXT 142 decrypts the next record, verifies its authenticity, and supplies a numeric value from the extracted record to comparator 224. Comparator 224 compares the numeric value to winning number 32, and communicates a result 230 to player 50. For each subsequent input from player 50, evaluator 40 extracts the next record from EPF 140, compares the numeric value in the extracted record to winning number 32, and furnishes result 230 to player 50. This process continues until EXT 142 retrieves and decrypts all records in EPF 140 or the game ends.

Figure 4:
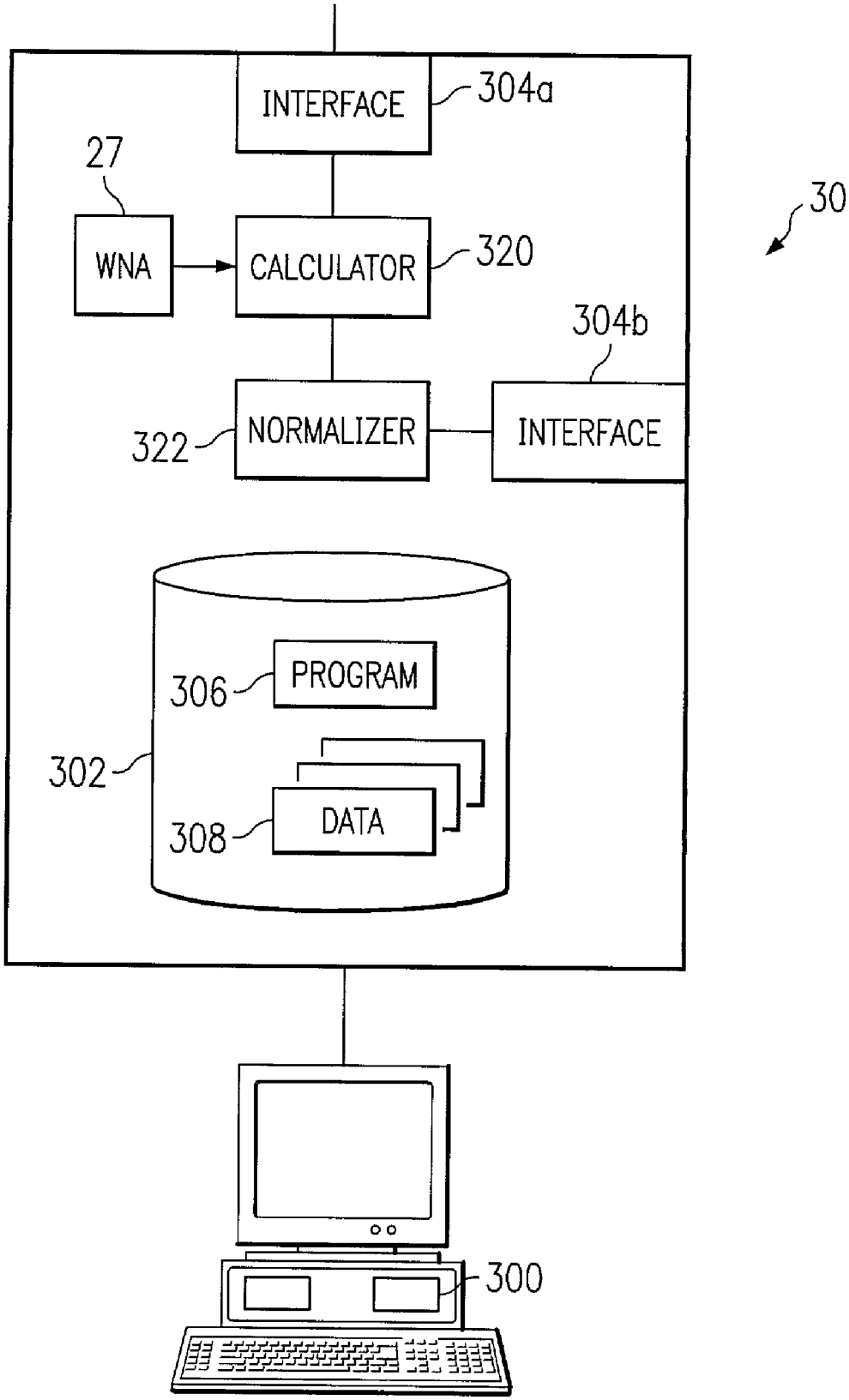
FIG. 4 is a block diagram illustrating exemplary components of the win generator.

FIG. 4 is a block diagram illustrating exemplary components of win generator 30. Win generator 30 may operate on a computer or other processing device, and includes generally a processor 300, memory 302, and one or more separate or integral interfaces 304 to receive information from or communicate information to other components in system 10. In the particular embodiment shown, interface 304*a* receives seeds 34 from random sources 36, and interface 304*b* provides communication between win generator 30 and play generator 20 and/or evaluator 40. Communication using interface 304*b* contemplates communicating winning number 32 to evaluator 40 and, optionally, to play generator 20. For purposes of winner verification, play generator 20 may receive winning number 32 from win generator 30 or receive seeds 34, WNA 27, or other information from win generator 30 that allows play generator 20 to generate winning number 32. Alternatively, play generator 20 may not need any information from win generator 30 to generate independently winning number 32.

Processor 300 may be a microprocessor, controller, or other suitable processing device that allows win generator 30 to perform its features and functions. Memory 302 includes a program 306 executed by processor 300 to control the overall functions and operation of win generator 30. The functions of program 306 are shown as modules (described below), but win generator 30 contemplates any arrangement and coordination of functions and features in one or more hardware and/or software components to accomplish the purposes of win generator 30. Memory 302 also stores data 308, which may include intermediate or final components of programs, data, or other information to be used by win generator 30.

In operation, win generator 30 receives seeds 34 from random sources 36 at interface 304*a*, and calculator 320 generates winning number 32 based on seeds 34 and WNA 27. A normalizer 322 optionally normalizes, adjusts, or otherwise processes winning number 32 to arrive at a final value for communication to evaluator 40 using interface 304*b*. Win generator 30 may operate as a stand-alone process or device, or may be integrated into evaluator 40 with external access to random sources 36 to retrieve seeds 34 for computation.

Figure 5:
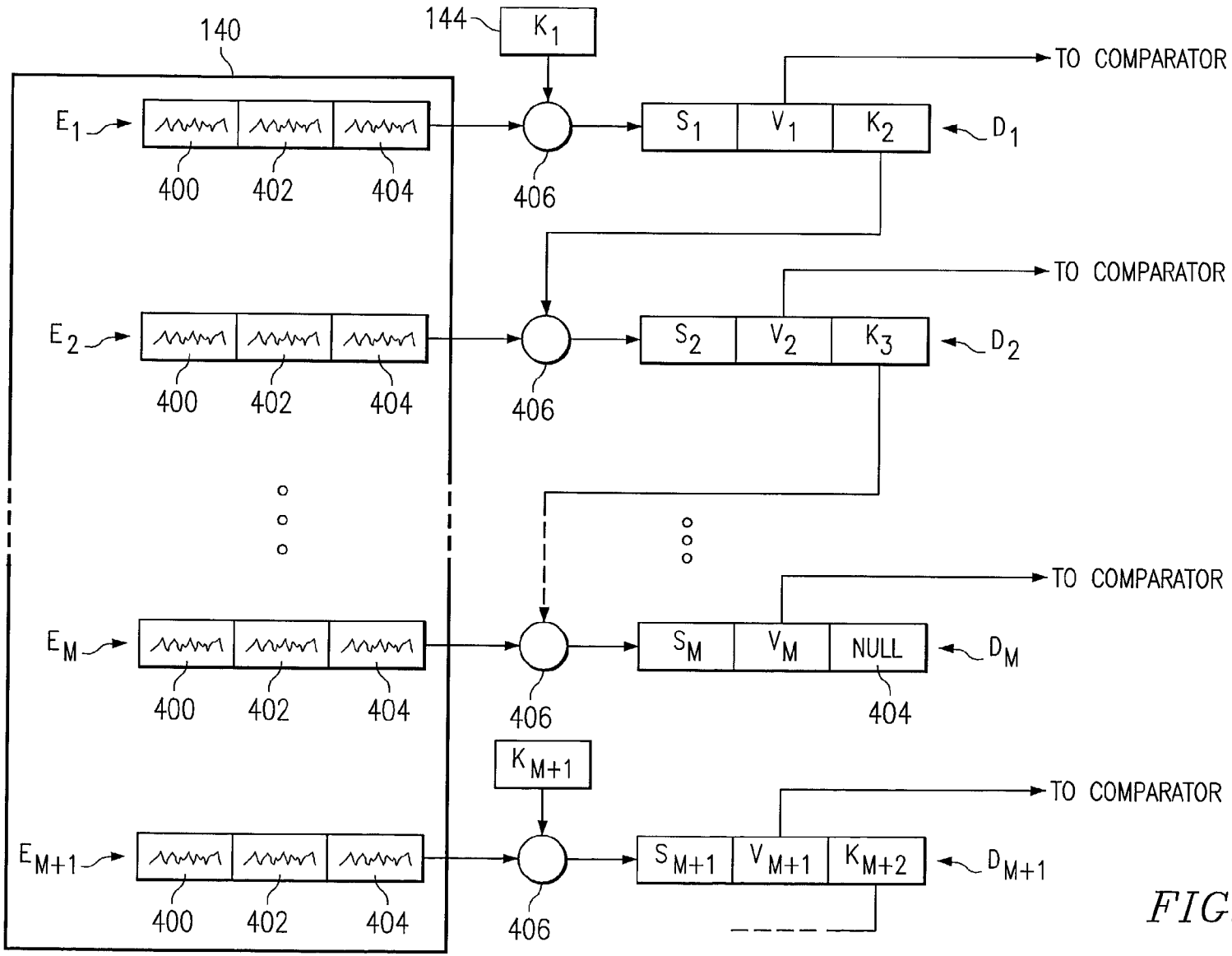
FIG. 5 illustrates a particular embodiment for processing records of a playfile.

FIG. 5 illustrates a record-by-record decryption technique used by EXT 142 in a particular embodiment of evaluator 40. EPF 140 includes a number of encrypted records E (e.g., $E_1$, $E_2$, . . . $E_m$, $E_{m+}$, . . . , each record representing a play of the game associated with playfile 22. In this particular embodiment, each record E includes a verification string 400, a numeric value 402, and a key 404. Since records E in EPF 140 are encrypted, verification string 400, numeric value 402, and key 404 are shown illustratively as unreadable. To decrypt record $E_1$, EXT 142 retrieves first key ($K_1$) 144 from playfile 22, and applies a decryption algorithm 406 to produce a decrypted record $D_1$ containing verification string 400 with a value of $S_1$, numeric value 402 with a value of $V_1$, and key 404 with a value of $K_2$. EXT 142 verifies record $D_1$ by comparing verification string $S_1$ to an authorized string maintained in memory 202 of evaluator 40. Upon verification of record $D_1$, EXT 142 passes numeric value $V_1$ to comparator 224 for comparison to winning number 32 to produce a win/loss result.

Upon receiving input from another player 50, EXT 142 uses key $K_2$ in record $D_1$ to decrypt the encrypted record $E_2$ to generate decrypted record $D_2$. Record $D_2$ includes verification string 400 with a value of $S_2$, numeric value 402 with a value of $V_2$, and key 404 with a value of $K_3$. EXT 142 performs the verification process on $S_2$, and passes $V_2$ to comparator 224 for determining a win/loss result. This process continues as EXT 142 decrypts, verifies, and retrieves numeric values for each subsequent record E in EPF 140.

In a particular embodiment, an intermediate record may include a null string or some other indication in key 404 to indicate that decryption of the next record requires an external key. In this example, record DM includes a null for key 404. Therefore, evaluator 40 receives external key $K_{M+1}$ to decrypt the next encrypted record $E_{M+1}$. In this manner, play generator 20 or other external site maintains continued control over the record-by-record decryption process performed by evaluator 40 by requiring external keys to decrypt certain intermediate records in EPF 140. For example, EPF 140 may include one thousand records, but every one hundred records includes a null or other indication in key 404 that triggers external key decryption. Therefore, any potential hack of EPF 140 to retrieve numeric values in bulk may only retrieve one hundred records until requiring an appropriate external key to decrypt the next record. This inclusion of external key decryption in intermediate records of EPF 140 may further reduce fraud.

FIG. 6 is a flow chart of method of operation of system 10. In an exemplary embodiment, play generator 20 performs steps 500, win generator 30 performs steps 600, and evaluator 40 performs steps 700. Although steps 500, 600, and 700 are shown in a particular sequence, system 10 contemplates any sequential or parallel operation of components to provide game plays to users of players 50.

The process executed by play generator 20 begins at step 502 where play generator 20 receives game information 24. Play generator 20 generates random numbers at step 504 and processes the generated random numbers at step 506 to adjust for the desired win probability 26. Play generator 20 encrypts the records at step 508, and generates playfile 22 at step 510 that may include, for example, EPF 140 and other components that allow evaluator 40 to perform record-by-record decryption. Play generator 20 communicates playfile 22 to evaluator 40 at step 512 using link 60.

The process performed at win generator 30 begins at step 602 where win generator 30 retrieves seeds 34 from public, verifiable random sources 36. Win generator 30 calculates winning number 32 at step 604 using seeds 34 and winning number algorithm (WNA) 27. Win generator 30 may normalize winning number 32 at step 606, and communicates winning number 32 to evaluator 40 at step 608 using link 70. Win generator 30 may be separate from or integral to evaluator 40. Moreover, the process described in steps 600 may be performed repeatedly by win generator 30 to generate any suitable number of winning numbers 32 based on one or more games and associated game information 24, or the number of prizes to be awarded for each game.

The process performed by evaluator 40 begins at step 702 where evaluator 40 checks the signature to verify the accuracy of playfile 22 received from play generator 20. If evaluator 40 fails to verify the accuracy of playfile 22 using SIG 146, evaluator 40 determines an error at step 703, and the process ends. If the signature is verified at step 702, evaluator 40 stores encrypted playfile (EPF) 140, EXT 142, and first key ($K_1$) 144 in memory 202 at step 704. In a particular embodiment, evaluator 40 verifies the accuracy of playfile 22 at step 702 and stores information at step 704 prior to win generator 30 performing steps 600, or even before random sources 36 generate seeds 34. In this manner, the generation, communication, verification, and storage of playfile 22 prior to generation of winning number 32 eliminates the possibility of fraudulent generation of records in playfile 22. Upon successfully receiving and storing EPF 140, evaluator 40 initializes EXT 142 at step 706 to begin retrieving records from EPF 140.

Upon receiving player input 228 at interface 204*c*, as determined at step 708, comparator 224 requests that EXT 142 extract the next record from EPF 140 using the stored key at step 710. For the first record, EXT 142 uses first key ($K_1$) 144 included in playfile 22. In a particular embodiment, EXT 142 extracts encrypted record E using decrypter 406 to retrieve verification string 400, numeric value 402, and key 404. EXT 142 verifies string 400 at step 712 using a stored authorized string. If the verification fails at step 712, evaluator 40 determines an error at step 703, and the process ends.

If the verification at step 712 passes, evaluator 40 stores key 404 to be used to decrypt the next record at step 714 and passes numeric value 402 to comparator 224 at step 716. Comparator 224 determines whether numeric value 402 matches winning number 32 at step 718, and determines a winner (step 720) or a loser (step 722) as a result of the comparison. If EXT 142 retrieved the last record from EPF 140 at step 724, or the game is over for some other reason, then the process ends. If EXT 142 has not retrieved the last record from EPF 140, the process continues at step 708 where evaluator 40 awaits the next input from player 50.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A system for playing a lottery-type game, comprising:

a play generator operable to generate a playfile without input from any player of the game, the playfile having a plurality of records, each record comprising a numeric value;

a win generator operable to generate a winning number based on:

a plurality of seeds from public, verifiable random sources; and a winning number algorithm received in the playfile from the play generator, the winning number algorithm specifying a numeric calculation using the seeds to generate the winning number; and an evaluator operable to receive the playfile and the winning number, the evaluator operable to retrieve a record from the playfile in response to input from a player, to compare a numeric value in the retrieved record to the winning number, and to communicate a win/loss result to the player; and wherein the play generator further comprises a verify module operable to receive the seeds and execute the winning number algorithm to verify the win/loss result.

2. The system of claim 1, wherein the evaluator receives the playfile in an electronic format at an interface coupled to a network that provides an electronic communication path between the evaluator and the play generator.

3. The system of claim 1, wherein the evaluator receives the playfile prior to the win generator generating the winning number.

4. The system of claim 1, wherein the evaluator is further operable to:

store the playfile prior to playing the lottery-type game, the playfile representing a number of plays at a win probability; and communicate a win/loss result to the player in a sufficiently small amount of time to convey a real-time play experience to a user of the player.

5. The system of claim 1, wherein the play generator generates a plurality of numeric values for the playfile based on a number of plays and a win probability.

6. The system of claim 1, wherein the random sources comprise a lottery result, weather data, or environmental noise.

7. The system of claim 1, wherein the playfile comprises an encrypted playfile and an extractor, the evaluator operable to decrypt, in response to input from the player, only a next record in the encrypted playfile using the extractor.

8. The system of claim 1, wherein the playfile comprises an encrypted playfile and an extractor, wherein the evaluator is further operable to:

decrypt a previous record in the playfile, the decrypted previous record comprising a key; and decrypt, in response to input from the player, only a next record in the encrypted playfile using the extractor and the key.

9. The system of claim 1, wherein the playfile comprises an encrypted playfile and an extractor, each record of the playfile comprises a verification string, a numeric value, and a key, the evaluator is further operable to:

decrypt a previous record in the playfile, the decrypted previous record comprising a key;

decrypt, in response to input from the player, only a current record in the encrypted playfile using the extractor and the key;

retrieve a verification string from the decrypted current record;

compare the verification string to an authorized string;

retrieve a numeric value from the decrypted current record if the verification string matches the authorized string; and retrieve a next key from the decrypted current record for use in decrypting a next record.

10. A method for playing a lottery-type game, comprising:

storing a playfile received from a remote location, the playfile having a plurality of records, each record comprising a numeric value;

receiving a plurality of seeds from public, verifiable random sources;

receiving a winning number algorithm that specifies a numeric calculation using the seeds to generate a winning number;

generating the winning number using the seeds and the winning number algorithm;

receiving input from a player;

retrieving a record from the playfile in response to the input;

comparing a numeric value in the retrieved record to the winning number to determine a win/loss result;

at the remote location, executing the winning number algorithm using the seeds to verify the win/loss result; and communicating the win/loss result to the player.

11. The method of claim 10, wherein the playfile is stored prior to determining a winning number.

12. The method of claim 10, wherein:

the playfile is stored prior to playing the lottery-type game, the playfile representing a number of plays at a win probability; and the step of communicating a win/loss result to the player is performed in a sufficiently small amount of time to convey a real-time play experience to a user of the player.

13. The method of claim 10, wherein the steps of retrieving, comparing, and communicating are performed locally at a single evaluator site without external communication.

14. The method of claim 10, wherein receiving a playfile comprises receiving a playfile in an electronic format from a remote location.

15. The method of claim 10, wherein the playfile comprises an encrypted playfile and an extractor, the retrieving step further comprising decrypting, in response to the input, only a next record in the encrypted playfile using the extractor.

16. The method of claim 10, wherein the playfile comprises an encrypted playfile and an extractor, the retrieving step further comprising:

receiving a key; and decrypting, in response to the input, only a next record in the encrypted playfile using the extractor and the key.

17. The method of claim 16, further comprising:

normalizing a numeric value in the decrypted record to adjust locally the win probability.

18. The method of claim 16, wherein receiving a key comprises decrypting a previous record in the playfile, the decrypted previous record comprising a key.

19. The method of claim 16, wherein receiving a key comprises receiving the key from a remote location.

20. The method of claim 10, wherein the playfile comprises an encrypted playfile and an extractor, each record of the playfile comprises a verification string, a numeric value, and a key, the retrieving step further comprises:

decrypting a previous record in the playfile, the decrypted previous record comprising a key;

decrypting, in response to the input, only a current record in the encrypted playfile using the extractor and the key;

retrieving a verification string from the decrypted current record;

comparing the verification string to an authorized string;

retrieving a numeric value from the decrypted current record if the verification string matches the authorized string; and retrieving a next key from the decrypted current record for use in decrypting a next record.

21. The method of claim 10, wherein the step of storing the playfile occurs before the step of determining the winning number.

22. A method for playing a lottery-type game, comprising:

storing a playfile received in an electronic format from a remote location, the playfile representing a number of plays and a win probability and including an encrypted playfile having a plurality of records and an extractor, each record of the playfile comprising a verification string, a numeric value, and a key;

after storing the playfile, receiving a winning number computed using a plurality of published, independent lottery results;

receiving a key;

decrypting, in response to input from a player, only a current record in the encrypted playfile using the extractor and the key;

retrieving a verification string from the decrypted current record;

comparing the verification string to an authorized string;

retrieving a numeric value from the decrypted current record if the verification string matches the authorized string;

normalizing a numeric value in the decrypted record to adjust locally the win probability;

comparing the numeric value to the winning number;

communicating a win/loss result to the player; and retrieving a next key from the decrypted current record for use in decrypting a next record.

23. The method of claim 22, wherein receiving a key comprises decrypting a previous record in the playfile, the decrypted previous record comprising a key.

24. The method of claim 22, wherein receiving a key comprises receiving a key communicated from a remote location.

25. The method of claim 22, wherein the step of communicating a win/loss result to the player is performed in a sufficiently small amount of time to convey a real-time play experience to a user of the player.

26. The method of claim 22, wherein the steps of retrieving a numeric value, comparing, and communicating are performed locally at a single evaluator site without external communication.

27. An apparatus for playing a lottery-type game, comprising:

a memory operable to store a playfile received from a remote location, the playfile having a plurality of records, each record comprising a numeric value, the memory further operable to store a winning number;

wherein the playfile comprises an encrypted playfile and an extractor, the processor further operable to:

receive a key;

decrypt, in response to the input, only a next record in the encrypted playfile using the extractor and the key; and normalize a numeric value in the decrypted record to adjust locally the win probability;

an interface operable to receive input from a player; and a processor operable to retrieve a record from the playfile in response to the input, to compare a numeric value in the retrieved record to the winning number, and to communicate a win/loss result to the player.

28. The apparatus of claim 27, wherein the memory stores the playfile prior to storing the winning number.

29. The apparatus of claim 27, wherein the playfile comprises an encrypted playfile and an extractor, the processor further operable to decrypt, in response to the input, only a next record in the encrypted playfile using the extractor.

30. The apparatus of claim 27, wherein the playfile comprises an encrypted playfile and an extractor, each record of the playfile comprises a verification string, a numeric value, and a key, wherein the processor is further operable to:

decrypt a previous record in the playfile, the decrypted previous record comprising a key;

decrypt, in response to the input, only a current record in the encrypted playfile using the extractor and the key;

retrieve a verification string from the decrypted current record;

compare the verification string to an authorized string;

retrieve a numeric value from the decrypted current record if the verification string matches the authorized string; and retrieve a next key from the decrypted current record for use in decrypting a next record.

31. Logic encoded in a computer-readable medium for playing a lottery-type game, the logic operable, when executed by a computer, to perform the following steps:

storing a playfile received from a remote location, the playfile having a plurality of records, each record comprising a numeric value;

determining a winning number based on:

a plurality of seeds from public, verifiable random sources; and a winning number algorithm received in the playfile from the play generator, the winning number algorithm specifying a numeric calculation using the seeds to generate the winning number;

receiving input from a player;

retrieving a record from the playfile in response to the input;

comparing a numeric value in the retrieved record to the winning number to determine a win/loss result;

at the remote location, executing the winning number algorithm using the seeds to verify the win/loss result; and communicating a the win/loss result to the player.

32. The logic of claim 31, wherein:

the playfile is stored prior to playing the lottery-type game, the playfile representing a number of plays at a win probability; and the step of communicating a win/loss result to the player is performed in a sufficiently small amount of time to convey a real-time play experience to a user of the player.

33. The logic of claim 31, wherein the playfile comprises an encrypted playfile and an extractor, the retrieving step further comprising decrypting, in response to the input, only a next record in the encrypted playfile using the extractor.

34. The logic of claim 31, wherein the playfile comprises an encrypted playfile and an extractor, the retrieving step further comprising:

receiving a key;

decrypting, in response to the input, only a next record in the encrypted playfile using the extractor and the key; and normalizing a numeric value in the decrypted record to adjust locally the win probability.

35. The logic of claim 31, wherein the playfile comprises an encrypted playfile and an extractor, each record of the playfile comprises a verification string, a numeric value, and a key, the retrieving step further comprises:

decrypting a previous record in the playfile, the decrypted previous record comprising a key;

decrypting, in response to the input, only a current record in the encrypted playfile using the extractor and the key;

retrieving a verification string from the decrypted current record;

comparing the verification string to an authorized string;

retrieving a numeric value from the decrypted current record if the verification string matches the authorized string; and retrieving a next key from the decrypted current record for use in decrypting a next record.

* * * * *